US005570714A

United States Patent [19]

Magish

[11] Patent Number: 5,570,714

[45] Date of Patent: Nov. 5, 1996

[54] EXPLOSION-RETARDANT CONTAINMENT VESSEL FOR STORAGE OF FLAMMABLE LIQUIDS

[75] Inventor: Jacob J. Magish, Brookfield, Conn.

[73] Assignee: Liquid Management Products, Inc., Bethel, Conn.

[21] Appl. No.: 33,135

[22] Filed: Mar. 18, 1993

[51] Int. Cl.[6] ..... B65D 90/04

[52] U.S. Cl. ..... 137/202; 137/209; 137/213; 137/264; 137/312; 220/426

[58] Field of Search ..... 137/202, 264, 137/312, 209, 213; 220/426

[56] References Cited

U.S. PATENT DOCUMENTS

| | | | |
|---|---|---|---|
| 2,871,669 | 2/1959 | Mann et al. | 220/426 X |
| 3,827,455 | 8/1974 | Lee | 137/264 X |
| 3,924,773 | 12/1975 | Wilkinson | 220/426 X |
| 4,241,747 | 12/1980 | King, Sr. | 137/202 X |
| 4,376,489 | 3/1983 | Clemens | 137/264 X |
| 4,552,166 | 11/1985 | Chadbourne, Sr. et al. | 137/15 |
| 4,641,680 | 2/1987 | Been | 137/312 |
| 4,862,909 | 9/1989 | Kim | 137/150 |
| 4,895,272 | 1/1990 | De Benedittis et al. | 137/312 X |
| 4,939,833 | 7/1990 | Thomas | 29/401 |
| 4,989,750 | 2/1991 | McGarvey | 220/444 |
| 5,004,632 | 4/1991 | McGarvey | 220/455 X |
| 5,005,615 | 4/1991 | McGarvey et al. | 137/312 X |
| 5,012,949 | 5/1991 | McGarvey | 220/455 |
| 5,038,456 | 8/1991 | McGarvey | 29/460 |
| 5,071,166 | 12/1991 | Marino | 280/830 |
| 5,082,138 | 1/1992 | McGarvey | 220/444 |
| 5,092,024 | 3/1992 | McGarvey | 29/460 |
| 5,103,996 | 4/1992 | McGarvey | 220/455 |
| 5,114,046 | 5/1992 | Bryant | 222/108 |
| 5,137,064 | 8/1992 | McGarvey et al. | 141/198 |
| 5,251,473 | 10/1993 | Reese | 137/264 X |
| 5,284,191 | 2/1994 | McGarvey | 137/312 X |

*Primary Examiner*—John Rivell
*Attorney, Agent, or Firm*—Clifford L. Tager

[57] ABSTRACT

The present invention is directed to an above-ground, explosion-retardant containment vessel for the storage of a flammable liquid. The containment vessel preferably comprises a primary storage tank capable of storing the flammable liquid and a containment dike surrounding the primary storage tank. The containment dike contains any leakage from the primary storage tank within the interstitial space existing between the exterior of the primary storage tank and the interior of the containment dike. An inert gas is preferably located within the interstitial space, and the interstitial space is further substantially free of oxygen. The inert environment retards the explosion of any flammable fluids which may leak into or otherwise be contained within the interstitial space. The containment vessel preferably further comprises a system capable of maintaining the pressure of the inert gas within the interstitial space to at least a predetermined pressure despite temperature variations. The containment vessel preferably further comprises a working vent from the interior of the primary storage tank to the exterior of the containment dike, and an emergency vent from the interior of the primary storage tank to the interstitial space.

6 Claims, 8 Drawing Sheets

EXPLOSION-RETARDANT CONTAINMENT VESSEL FOR STORAGE OF FLAMMABLE LIQUIDS

BACKGROUND OF THE INVENTION

1. Technical Field

The present invention is directed to a containment vessel. More particularly, the present invention is directed to an explosion-retardant containment vessel for the above-ground storage of flammable liquids.

2. Background Information

Above-ground containment vessels are well known in the art. For example, U.S. Pat. No. 5,071,166 to Marino shows a containment vessel comprising a primary storage tank encased within an outer enclosure. In the event the primary storage tank develops a leak or otherwise ruptures, the fluid which has leaked from the primary storage tank will be contained within the interstitial space located between the exterior of the primary storage tank and the interior of the outer enclosure.

Containment vessels are often employed to store flammable liquids, such as gasoline or aviation fuel. Should any fuel leak from the the primary storage tank, it will be contained within the interstitial space. As will be appreciated by those skilled in the art, the combination of a combustible material, oxygen, and temperature at or above the ignition point of the combustible material is highly explosive given the proper proportions of fuel and oxygen.

Given the relatively large amount of gasoline contained within the primary storage tank, the oxygen inherent in the air within the interstitial space, and the relatively large amount of metal from which the vessel is manufactured, the prior art containment vessel can create a critically dangerous environment.

SUMMARY OF THE INVENTION

The present invention is directed to an above-ground, explosion-retardant containment vessel for the storage of a flammable liquid. The containment vessel preferably comprises a primary storage tank capable of storing the flammable liquid, and a containment dike surrounding the primary storage tank. The containment dike contains any leakage from the primary storage tank and associated piping within the interstitial space existing between the exterior of the primary storage tank and the interior of the containment dike.

An inert gas is preferably located within the interstitial space, and the interstitial space is further substantially free of oxygen. The inert environment retards the explosion of any flammable fluids which may leak into or otherwise be contained within the interstitial space, regardless of the relative amounts of either flammable fluid or heat.

The containment vessel preferably further comprises a system capable of maintaining the pressure of the inert gas within the interstitial space to at least a predetermined pressure, despite temperature variations which naturally occur due to continuous environmental temperature fluctuations.

The system capable of maintaining the pressure of the inert gas preferably comprises a supply of the inert gas, a first regulator ported to the interstitial space, and a second regulator connected between the inert gas supply and the first regulator.

The inert gas is preferably contained within a storage tank and pressurized under a first pressure, substantially higher than the predetermined pressure of the inert gas within the interstitial space. The first regulator is capable of supplying the interstitial space with the inert gas at the predetermined pressure and maintaining the pressure of the inert gas within the interstitial space to at least the predetermined pressure. The second regulator reduces the pressure of the inert gas from the first pressure to an intermediate pressure between the first pressure and the predetermined pressure.

The containment vessel preferably further comprises a working vent from the interior of the primary storage tank to the exterior of the containment dike. The working vent is preferably a pressure/vacuum conservation vent to restrict the flow of vapors until the differential pressure thereof exceeds the pressure setting of the working vent.

The containment vessel preferably further comprises an emergency vent from the interior of the primary storage tank to the interstitial space. Thus, if the primary storage tank should ever be filled beyond its capacity, the overflow will be contained within the interstitial space.

The containment dike preferably has at least a 35% overfill capacity, relative to the volumetric capacity of the primary storage tank. Thus, should the primary storage tank overfill or leak, the containment dike preferably can contain all of the liquid in the primary storage tank, as well as at least an additional 35%.

The containment vessel preferably comprises a primary storage tank and a containment dike comprising a roof having a substantially semi-circular cross-section. The containment dike preferably completely surrounds the primary storage tank to contain any leakage from the primary storage tank within the interstitial space existing between the exterior of the primary storage tank and the interior of the containment dike.

Structural advantages are gained by a semi-circular roof which completely surrounds the primary storage tank. For example, the amount of interstitial space is increased, relative to prior art designs.

Another advantage of the semi-circular roof is the ability to easily pressurize the interstitial space. By pressurizing the interstitial space with an inert gas, an explosion-retardant environment is achievable.

Additionally, the semi-circular roof offers greater solar energy reflectivity, relative to a roof having flat panels. Thus, a higher percentage of sunlight is reflected, minimizing the amount of thermal energy absorbed by the interstitial space.

In addition to the roof having a substantially semi-circular cross-section, the containment dike preferably further comprises a base and structurally reinforced walls connecting the base to the roof.

Further structural advantages are obtained by having structurally reinforced walls. For example, the structure can withstand a direct collision, as well as an external flood, the height of which is dependent on the thickness of the walls.

The containment vessel preferably further comprises a pumping compartment integrally connected to the containment dike. The pumping compartment is preferably capable of either pumping flammable liquid into the primary storage tank or drawing flammable liquid therefrom.

Other advantages are gained by a pumping compartment integral with the containment dike. For example, the containment vessel is self-contained. Additionally, the unibody construction totally encloses the storage tank, the pumping compartment, and all piping therebetween. Thus, leaks are contained, piping is protected, and the unit is easily transportable.

DESCRIPTION OF THE PREFERRED EMBODIMENT(S)

The containment vessel of the present invention finds particular utility in the storage of flammable liquids. While the present invention is described hereinbelow with reference to the storage of aviation fuel, it is to be understood that the present invention is not so limited. The present invention is equally suitable for the storage of other liquids, regardless of their viscosity, whether flammable or inflammable, hazardous or otherwise.

Figure 1:
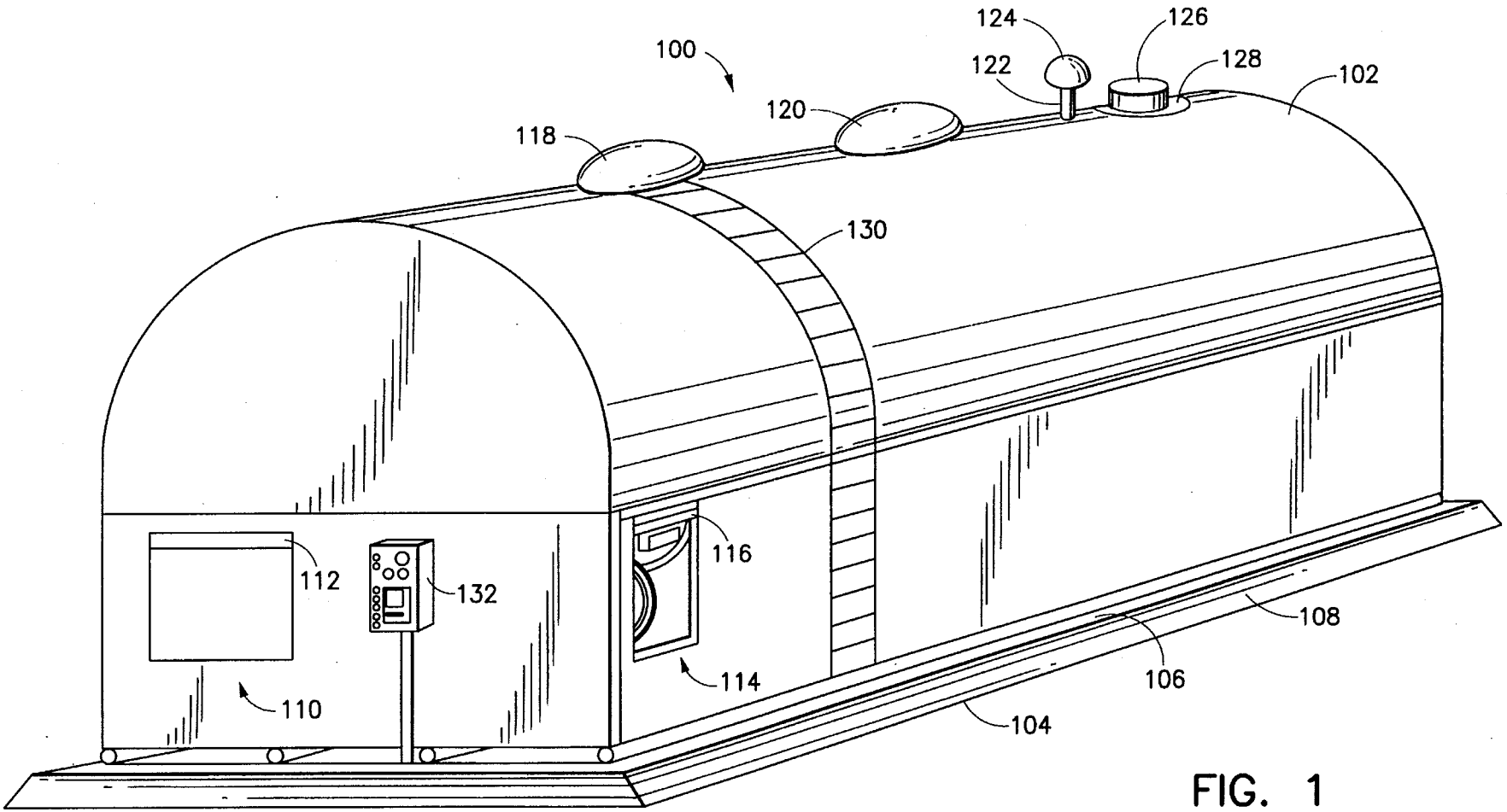
FIG. 1 illustrates an oblique view of the containment vessel of the present invention.

Turning now to FIG. 1, an oblique view of the containment vessel of the present invention is illustrated. Containment vessel 100 comprises a primary storage tank (not shown) housed within containment dike 102. The containment vessel is preferably locatable on platform 104, which, although site-specific, is preferably a reinforced concrete slab at least 12 inch thick having dead-level top surface 106 with sloped sides 108 to allow rain and other moisture to migrate away therefrom.

Solar energy impinging on the surface of the containment vessel can cause the interior temperature thereof to increase. To minimize the amount of absorbed radiated energy, the exterior surface of the containment vessel preferably has a white coating thereon. Preferably, the white coating comprises a first layer of V-75-W-9 and a second layer of 89-W-9, both manufactured by Valspar. This combination reflects about 86% of the solar energy impinging thereon.

As explained in more detail below, fuel is pumped into the primary storage tank located within containment dike via a pumping system, accessible via opening 110 and door 112. Fuel is removed therefrom by a hose accessible via opening 114 and door 116.

As also explained in more detail below, the containment vessel further comprises maintenance manhole 118, inspection manhole 120, working vent 122 with pressure-vacuum flame arrestor 124, emergency vent 126, emergency vent access 128, ladder 130 and control panel 132.

Figure 2:
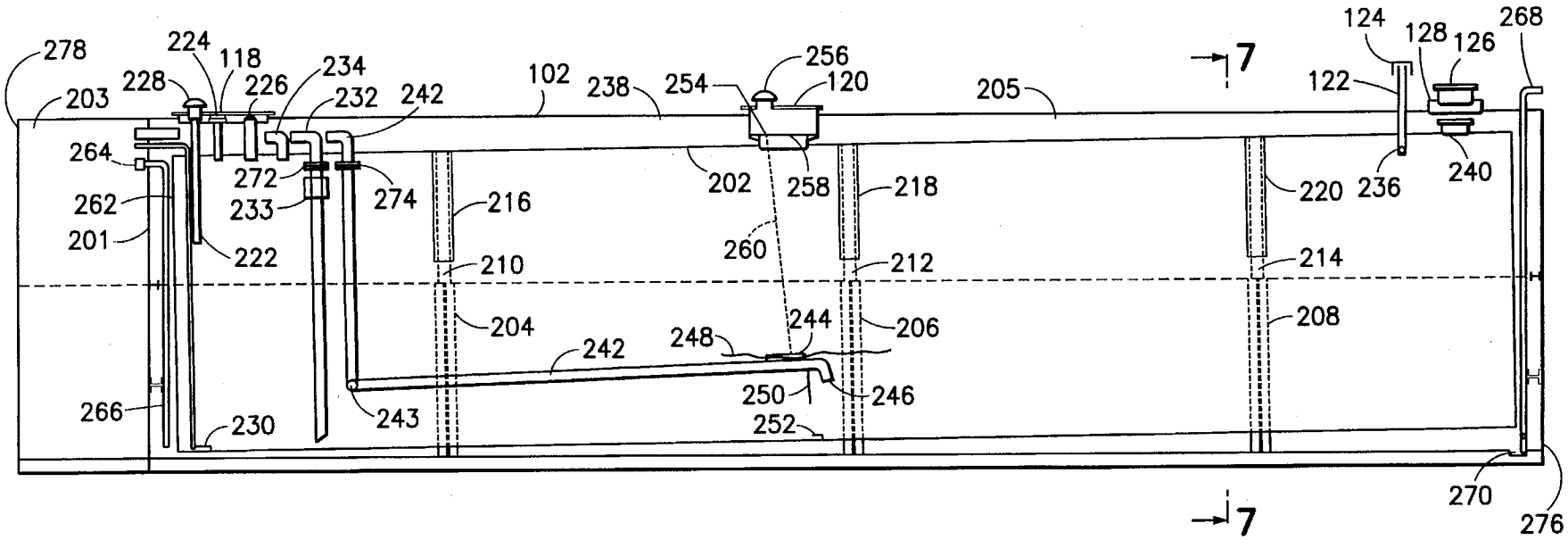
FIG. 2 is a sectional view of the containment vessel shown in FIG. 1, taken along the longitudinal axis thereof.

Turning now to FIG. 2, a sectional view of the containment vessel taken along the longitudinal axis is depicted. The containment vessel is divided by firewall 201, separating pumping compartment 203 from containment section 205.

Firewall 201 is preferably a ¼ inch thick steel plate having a coating of fire-retardant material (not shown) thereon to protect containment section 205 from any fire within pumping compartment 203.

The coating of fire-retardant material preferably is located on the side of the firewall facing the pumping compartment, and preferably comprises two layers of a cementitious backer unit distributed by Georgia Pacific under the mark Util-A-Crete®, adhered to the firewall via an epoxy available from by TVT as stock number 7482A32.

Each layer is preferably 9/16 inch thick, each layer being capable of retarding direct fire for an hour, thereby providing a 2 hour fire rating. When exposed to fire, the cementitious backer unit flakes, thereby absorbing the heat of the fire while keeping the side not exposed to the fire cool.

As shown in FIG. 2, primary storage tank 202 is preferably seated in saddles 204, 206 and 208, and secured thereto via hold-down plates 210, 212 and 214, respectively. Dielectric pads 216, 218 and 220 are preferably located between the hold-down plates and the primary storage tank to minimize galvanic action therebetween.

Saddle 206 preferably supports the center of the tank, while saddles 204 and 208 support respective ends thereof. The saddles are preferably located a predetermined distance apart, according to UL-142 specifications.

Preferably, stops (not shown) are located on primary storage tank 202 on either side of each saddle to limit the amount of longitudinal travel of the primary storage tank. The stops are preferably curved bars welded to the underside of the primary storage tank and preferably withstand seismic-4 forces.

Primary storage tank 202 is preferably manufactured from ¼ inch steel, with ¼ inch steel heads butt-welded thereon, manufactured and reinforced according to UL-142 specifications. The shape of the tank is preferably cylindrical with a substantially circular cross-section having a 9 foot, 3 inch diameter. Thus, a one foot section thereof can hold about 500 gallons of liquid. Other storage tank configurations will be obvious to those skilled in the art.

The interior surface of the primary storage tank is preferably coated to protect and preserve the lining thereof from, e.g., chemical corrosivity, mechanical abrasion, and rust. The interior surface of the primary storage tank is preferably prepared by sandblasting same to SP-10 (near-white) standards. The interior is then preferably coated with two layers of V-78-W-3, manufactured by Valspar.

Figure 3:
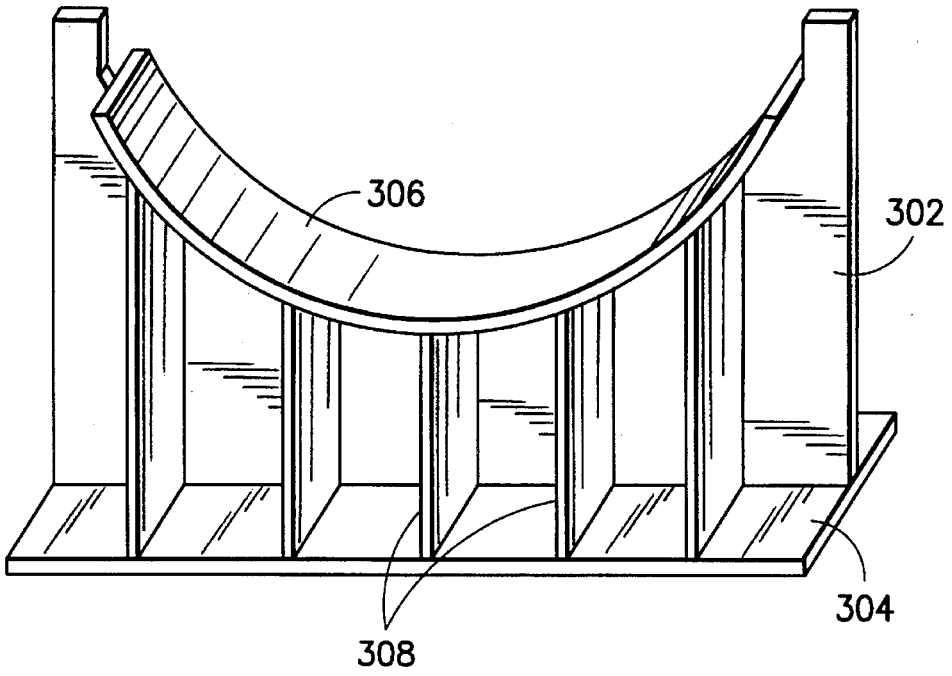
FIG. 3 shows a detailed view of a saddle shown in FIG. 2.

With reference to FIG. 3, an oblique view of a saddle in which the primary storage tank is seated is depicted. The saddle preferably comprises bulkhead 302 located on plate 304. The primary storage tank preferably rests on plate 306, with a plurality of gussets 308 on both sides of bulkhead 302 to provide additional support therefor. A dielectric pad (not shown) is preferably located between plate 306 and the primary storage tank to minimize galvanic action therebetween.

In the preferred embodiment, bulkhead 302 is ⅜ inch steel, and plates 304, 306 and gussets 308 are ¼ inch steel. The bulkhead, plates and gussets are preferably adjoined via continuous welds at each abutment, and each saddle is preferably manufactured according to UL-142 standards.

As discussed in more detail below, the width of the bulkhead is preferably sufficient to contact the side walls of the containment dike, where it is securely attached thereto via continuous welds at each abutment. Plate 304 is preferably securely attached to the base of the containment dike via continuous welds at each abutment.

Returning to FIG. 2, primary storage tank 202 is preferably sloped, e.g., at the rate of ⅛ inch rise per linear foot. Sloping is preferably achieved by varying the height of plate 306, relative to plate 304, on each saddle (FIG. 3). Other sloping arrangements will be obvious to those skilled in the art.

Preferably accessible via maintenance manhole 118 are stick access 222, emergency high-level detector 224, and volumetric controller 226.

Stick-access 222, accessible through hatch 228 in maintenance manhole 118, is preferably provided to manually determine the overall fluid level within the primary storage tank. A measuring stick (not shown) is inserted therethrough, preferably coming to rest on strike plate 230 before it is removed to determine the fluid level mark left thereon.

Emergency high-level detector 224 is preferably provided to detect when the fluid level in the primary storage tank exceed a predetermined level, defined to be indicative of an emergency condition. As explained in detail below with reference to a filling operation, if the fluid level in the primary storage tank exceed the predetermined level, the emergency high-level detector shuts off a pump motor located in pumping compartment 203 to prevent further fuel intake. Emergency high-level detector 224 is preferably available from Warrick Controls, Inc., as part number FE1B1A9B.

Volumetric controller 226 is preferably provided to detect the overall fluid level within the primary storage tank, as well as the water/fuel boundary, determining the volume of the fuel and water within the tank. The volumetric information is preferably displayed on a panel (not shown). The volumetric controller is also preferably programmable to indicate a plurality of different fluid levels within the tank, allowing a site manager to specify, e.g., a "high level" condition, a "low level" condition, or when the tank is half full.

Volumetric controller 226 is preferably available from EBW in Muskegon, Mich., as part number 950-ASP, which is capable of indicating up to six different fluid levels and having a sensitivity to changes in fluid levels to 0.05 gal/hr. This sensitivity will allow a site manager to notice small losses and investigate same in a preventative maintenance mode.

Drop supply tube 232 is preferably provided to transport fuel into primary storage tank 202 from pumping compartment 203. Drop supply tube 232 preferably includes shut-off valve 233 in-line therewith to close its inlet when fluid level reaches a predetermined height in the tank, indicative of the tank being substantially full. Shut-off valve 233 is preferably a Solo Filling Limiter, part number 1228.

Vapor recovery tube 234, connectable to the supply vehicle delivering the fuel, is preferably provided to allow vapors displaced by the filling operation to be recovered by the supply vehicle.

Working vent 122 is preferably provided to allow vapor pressure within primary storage tank 202 to escape into the atmosphere in the event vapor recovery tube 234 is not connected to the supply vehicle during a fuel delivery.

Working vent 122 preferably includes a pressure/vacuum conservation vent in combination with flame arrestor 124 and liquid check valve 236. The pressure/vacuum is preferably set at about +16 ozs./−1 oz. Thus, atmosphere can enter the primary storage tank should differential pressure therebetween drop below the low setting, and vapor within the primary storage tank can vent should the differential pressure exceed the high setting. Flame arrestor 124 preferably inhibits the propagation of fire from one side thereof to the other. Working vent 122 is preferably part number "PVV-548-3", and flame arrestor 124 is preferably part number 351S, both manufactured by Morrison Bros. Co.

Liquid check valve 236, commonly referred to as an extractor valve, is preferably provided to vent only vapor through working vent 122. In the event the primary storage tank is overfilled, excess fluid will escape into interstitial space 238 via emergency vent 240 rather than outside the containment vessel via working vent 122.

Liquid check valve 236 is preferably a Universal 38-306018 float vent valve connected to the working vent via a Universal V421-003 vent valve assembly. Emergency vent 240 is preferably a Morrison Bros. Co. 244F connected to the primary tank via a Morrison Bros. Co. 244A flanged adapter.

As explained in more detail below, interstitial space 238 is preferably purged of air and is replaced with an inert gas, such as nitrogen. By removing the oxygen (inherent in air) and creating an inert environment in the interstitial space, the present invention retards the explosion of any flammable fluids contained within the interstitial space.

Fuel is preferably removed from the primary storage tank via floating suction tube 242 which rotates about swivel 243. Float 244 is preferably provided to keep inlet 246 just below the top of fuel level 248, thereby minimizing the draw of particulate and/or water which will eventually settle to the bottom of the primary storage tank.

Floating suction tube 242 preferably also includes leg 250 which will rest on strike plate 252 when the fuel level therein is low, thereby precluding fuel being drawn off the bottom of the tank.

Float test access 254, accessible via hatch 256 in inspection manhole 120, is preferably provided by tank access manhole 258 to test the operability of floating suction tube 242 via wire 260.

Containment dike emergency vent 126, located on primary tank emergency vent access 128, is preferably a pressure/vacuum vent set at about +2.0 lbs./−2 oz. Thus, atmosphere can enter into interstitial space 238 should pressure therein drop below the low setting, and inert gas within the interstitial space can escape therethrough when its pressure exceeds the high setting. Containment dike emergency vent 126 is preferably a Protectoseal Corp. Series 85TOH with standard flanged ANSI connections.

Any moisture in the fuel will eventually precipitate to the bottom of the primary storage tank. Sloping the tank allows the water to collect for ultimate removal via water purge line 262.

Probing device 264 preferably includes a plurality of liquid and vapor sensors located along line 266 to detect liquid and/or vapors at the base of or otherwise within the interstitial space. Probing device 264 is preferably manufactured by Warrick Controls, Inc. The liquid sensor is preferably Warrick part number DSC-12B, and the vapor sensor is preferably Warrick part number DVP-2.

Interstitial suction line 268 is provided to purge liquid and/or fuel vapor from interstitial space 238. The terminal end of interstitial suction line 268 preferably resides in sump pit 270 within the base of the containment vessel.

Figure 4:
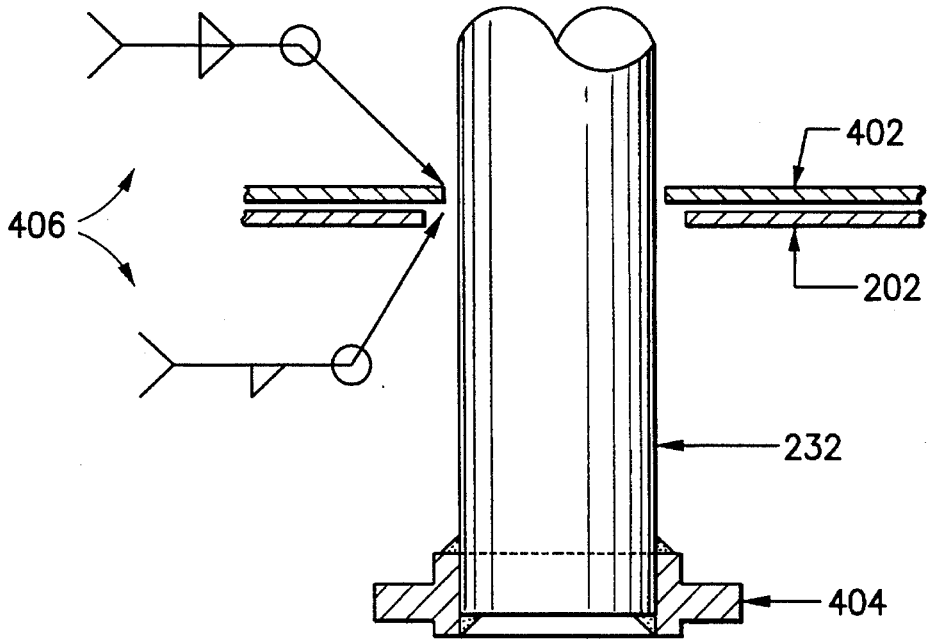
FIG. 4 depicts a typical cross-sectional view of piping through the primary storage tank shown in FIG. 2.

With reference to FIG. 4, a typical cross-sectional view of piping through the primary storage tank is depicted. All piping into primary storage tank 202, such as drop supply tube 232 (FIG. 2), preferably passes through a steel reinforcing plate such as plate 402. A flange, such as flange 404, is preferably employed where piping inside the primary storage tank is interconnected, such as with drop supply tube 232 and floating suction tube 242 (FIG. 2). Piping, plate 402 and flange 404 are preferably welded in place as shown via continuous welds 406.

Figure 5:
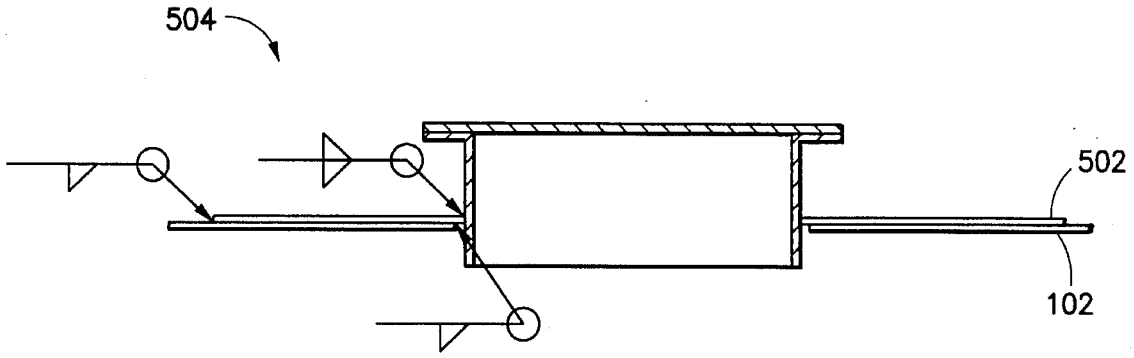
FIG. 5 depicts a typical cross-sectional view of an access through the containment dike shown in FIG. 2.

With reference to FIG. 5, a typical cross-sectional view of an access through the containment dike is depicted. All accesses through containment dike 102, such as maintenance manhole 118, inspection manhole 120 and access 128, preferably pass through the containment dike via an appropriate opening, which is reinforced by plate 502. Access and plate 502 are preferably welded in place as shown via welds 504. Reinforcing plates 502 are preferably 3/16 inch steel plates, and welds 504 are preferably continuous welds.

Figure 6:
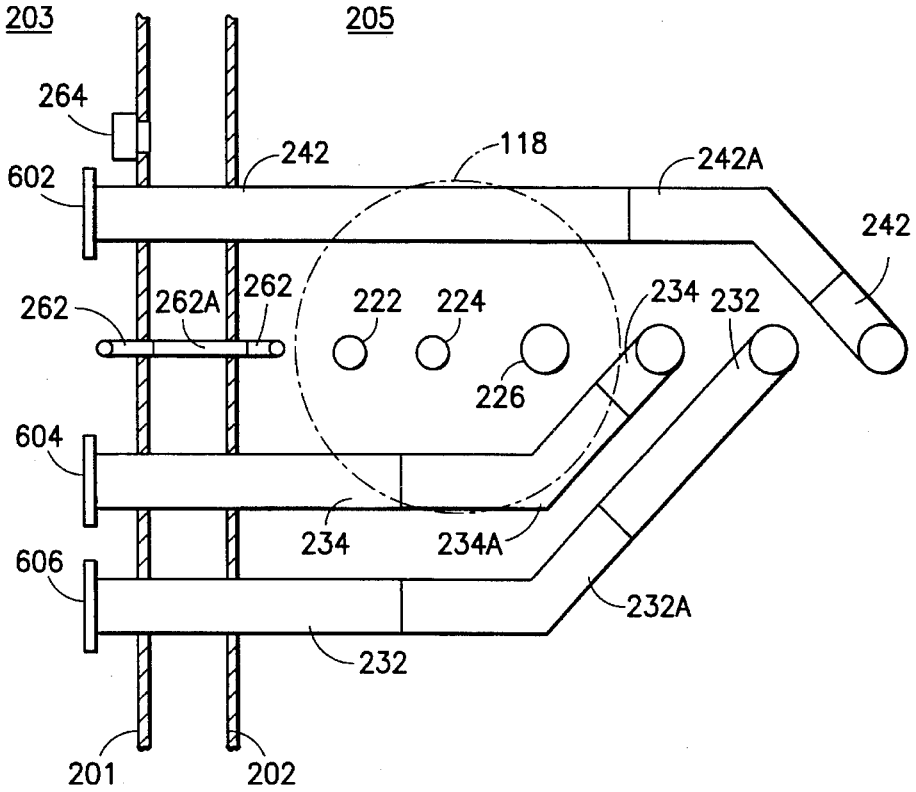
FIG. 6 shows a detailed top view of the area circumjacent to the maintenance manhole shown in FIG. 2, illustrating the piping from the pumping compartment to the primary storage tank.

With reference to FIG. 6, a detailed top view of the area circumjacent to maintenance manhole 118, illustrating the piping from pumping compartment 203 to primary storage tank 202, is shown. All piping passing from pumping compartment 203 to primary storage tank 202 via firewall 201 preferably contains a section of flexible piping to absorb expansion, contraction and vibration.

For example, floating suction tube 242 contains flexible section 242A; vapor recovery tube 234 contains flexible section 234A; drop supply tube 232 contains flexible section 232A; and water purge line 262 contains flexible section 262A.

Floating suction tube 242, vapor recovery tube 234, drop supply tube 232, and the flexible sections associated therewith are preferably 3 inch OD, number 304 stainless steel piping and flexible stainless steel piping, respectively. Water purge line 262 and flexible section 262A are preferably 1 inch OD, number 304 stainless steel piping and flexible stainless steel piping, respectively.

To reduce the possibility of leakage in the interstitial space, piping is either connected within pumping compartment 203 via flanges 602, 604 and 606 and gaskets (not shown), or within primary storage tank 202 via flanges 272 and 274 (FIG. 2) and gaskets therebetween (not shown).

Figure 7:
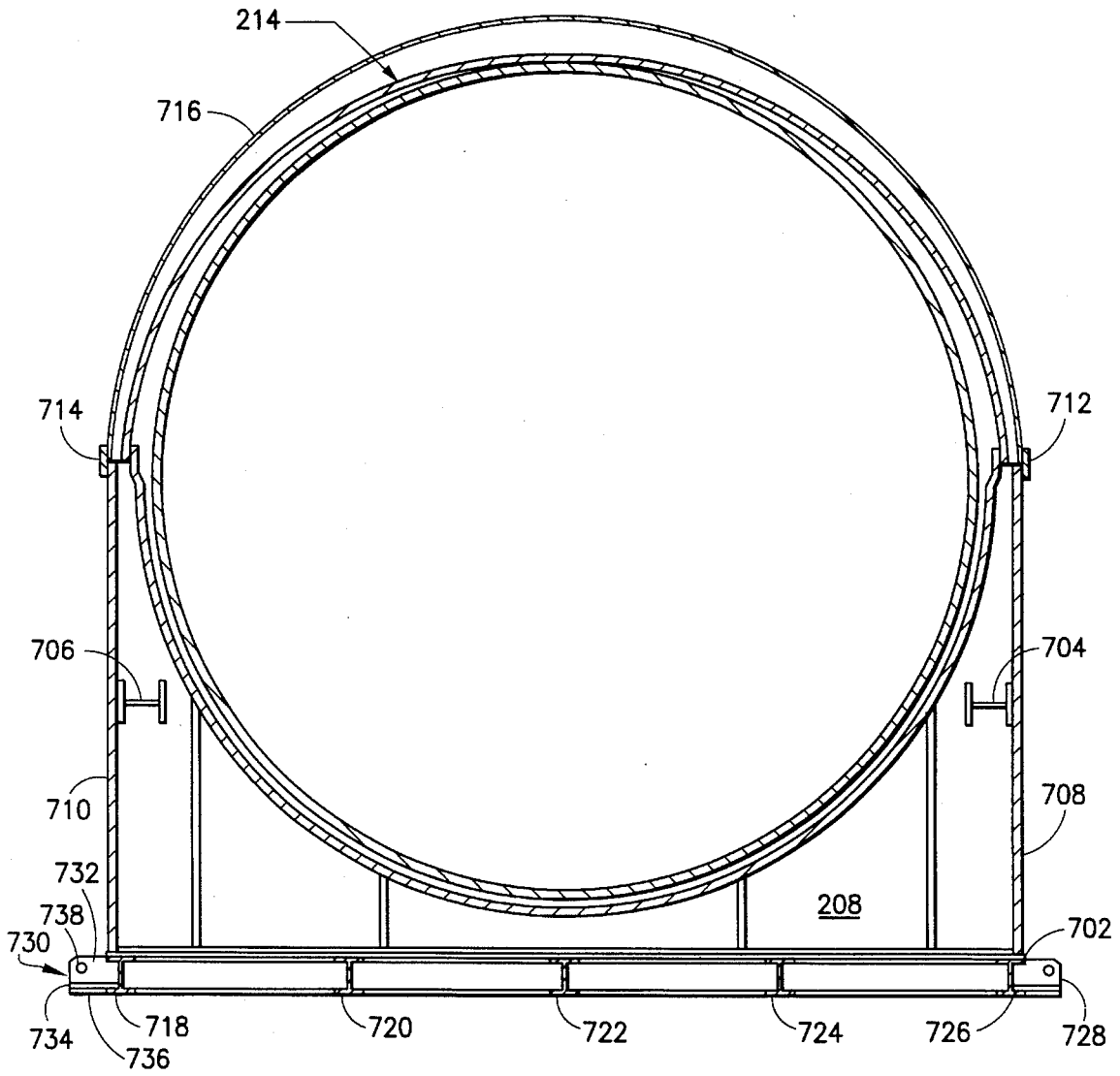
FIG. 7 depicts a sectional view of the containment vessel shown in FIG. 2, taken along axis 7—7.

Turning to FIG. 7, a sectional view of the containment vessel shown in FIG. 2, taken along axis 7—7, is depicted. The containment vessel of the present invention preferably comprises base 702 to which all saddles, such as saddle 208, are welded.

Beams, such as beams 704 and 706, are preferably welded between each saddle, between saddle 204 and firewall 201, as well as between saddle 208 and rear wall 276 (FIG. 2). The beams are preferably welded in place via clip angles (not shown) located about midheight of the saddles. Side walls 708 and 710 are preferably welded to base 702, the bulkhead of each saddle, the firewall, and the beams running therebetween, such as beams 704 and 706, respectively.

Beams 712 and 714 are preferably located on the top surface of each saddle, over side walls 708 and 710, respectively, and preferably extend the entire longitudinal length of the containment vessel.

After primary storage tank 202 is placed in the saddles, it is secured thereto via hold-down plates, such as hold-down plate 214, preferably with a dielectric pad (not shown) placed therebetween.

Roof 716 is preferably attached between the exterior lips of beams 712 and 714. Due to the longitudinal length of the containment vessel, roof 716 preferably comprises a plurality of sections. To facilitate the abutment of roof sections, plates (not shown) are preferably located under the roof sections where adjacent roof sections abut.

To insure minimum loss of the inert gas within the interstitial space of the containment section, base 702, side walls 708 and 710, rear wall, firewall, roof 716, beams 712 and 714, and saddles are preferably respectively connected via continuous welds at all abutment surfaces.

The base, side walls and roof are preferably ¼ inch steel plates. Beams 704 and 706 are preferably W6×16 I-beams. Beams 712 and 714 are preferably W4×13 I-beams.

Base 702 is attached to a support structure which preferably comprises six support beams (not shown) located substantially under front wall 278, firewall 201, saddles 204, 206 and 208, and rear wall 276 (FIG. 2), and five equidistantly-spaced beams 718, 720, 722, 724 and 726 which run parallel to the longitudinal axis of the containment vessel.

Support beams 718 and 726 preferably run the entire length of the containment vessel, parallel to the longitudinal axis thereof. The six support beams which run perpendicular to the longitudinal axis (i.e., those support beams located under the front wall, firewall, rear wall and saddles) are preferable secured between beams 718 and 726 via clip angles. Support beams 720, 722 and 724 are preferably secured between the six beams which run perpendicular to the longitudinal axis via clip angles. The beams which comprise the support structure are preferably W5×16 I-beams, continuously welded to each other, as well as to base 702, at all abutment surfaces.

Preferably, anchor plate and lifting lug assemblies 728 and 730 are located along beams 726 and 718, respectively, at the terminal ends of the support beam located under saddle 208. Another set of anchor plate and lifting lug assemblies (not shown) is preferably located along beams 726 and 718 at the terminal ends of the support beam located under the firewall.

Each anchor plate and lifting lug assembly, e.g., 730, preferably comprises plate 732 secured perpendicularly to plate 734. Plate 736 is preferably located below plate 734 to compensate for the height of the lower lip of beam 718. The containment vessel is preferably secured to the platform via hold-down bolts (not shown) through plates 734 and 736. Preferably, continuous welds secure the components of each anchor plate and lifting lug assembly, both to itself and to beams 718 and 726.

Each anchor plate and lifting lug assembly preferably allows two hold-down bolts to be placed therethrough to secure the containment vessel to the platform. The type of hold-down bolts and depth of penetration into the platform preferably meet Seismic-4 standards. The containment vessel is preferably liftable via appropriate attachment to the anchor plate and lifting lug assemblies, e.g., via opening 738.

A zinc-based primer is preferably adhered to the undercarriage of base 702 and the support structure to inhibit rust and corrosion. To help inhibit galvanic action between the support structure and the platform on which the containment vessel is located is preferably a 20 mil thick dielectric pad (not shown).

A grounding attachment and wire (not shown) are preferably located on the containment vessel in compliance with applicable NEC regulations. The grounding attachment and wire are preferably electrically connected to the earth to electrically ground the containment vessel, thereby reducing any electrical potential build-up, e.g., caused by static or lightning.

Figure 8:
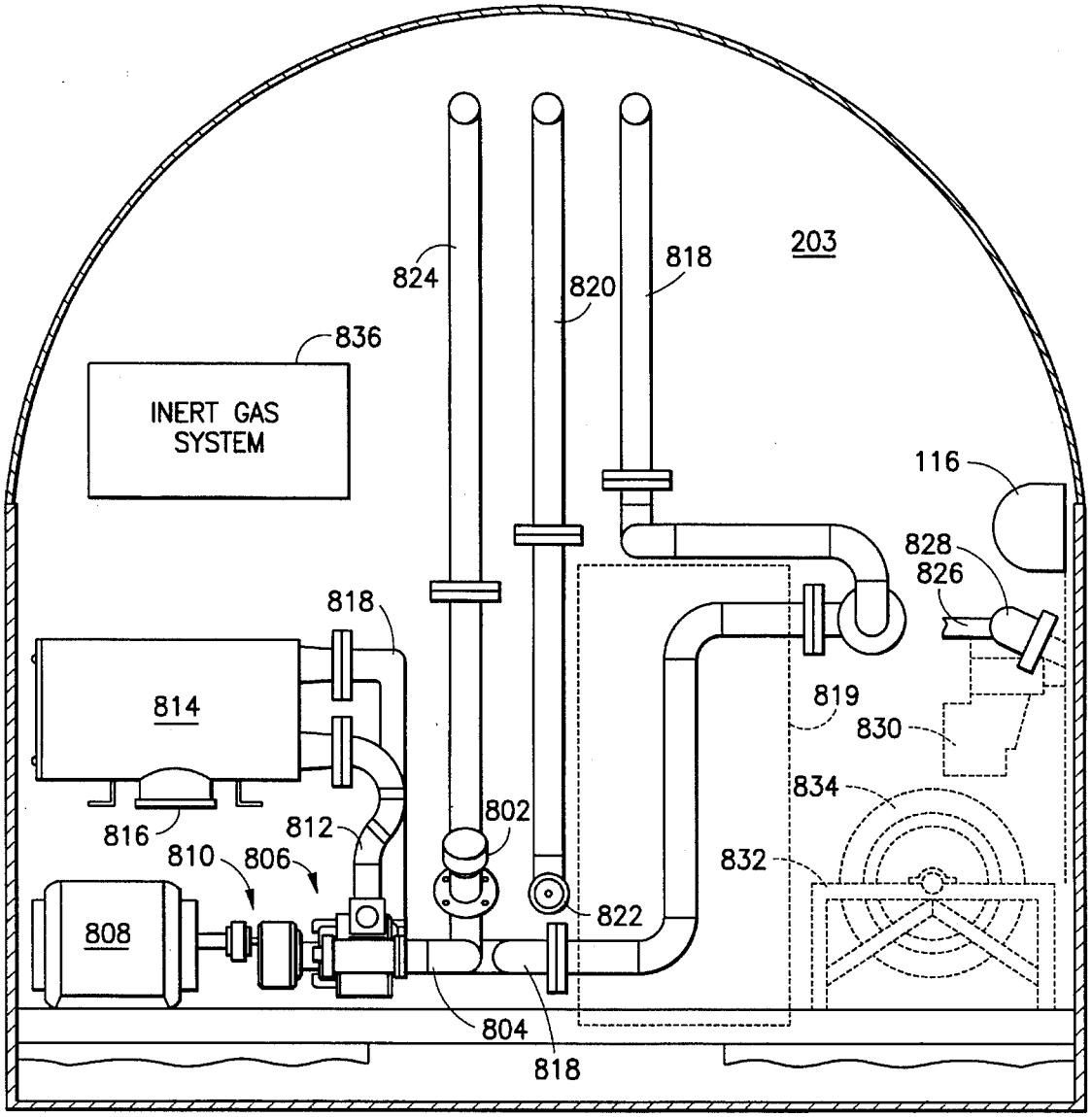
FIG. 8 is a sectional view of the pumping compartment shown in FIG. 2.

FIG. 8 is a sectional view of the pumping compartment shown in FIG. 2. In the preferred embodiment, the pumping system located within pumping compartment 203 delivers fuel to the primary storage tank, as well as retrieving fuel therefrom. In this way, the containment vessel of the present invention has control over both operations, thereby allowing certain safety features (discussed below) to be more easily implemented.

Fuel enters inlet port 802, traveling through piping 804 to fuel pump 806, which is driven by pumping motor 808 and gearbox assembly 810. The fuel is pumped via piping 812 into filter/separator 814, which preferably includes sump and observation tank area 816 allowing the fuel to be observed and/or drawn off.

Filter/separator 814 is preferably provided to remove water contained in the fuel. The water separated therefrom is preferably diverted to sump area 816 where an optional heater preferably insures that the water in the sump does not freeze.

The separated water collects in sump 816 until drawn off. Should the separated water reach a predetermined height in the sump, a liquid level detector (not shown) preferably causes the fuel pump to shut off until the water is drawn off.

Fuel exits filter/separator 814 via piping 818 which leads to the primary storage tank via drop supply tube 232 (FIG. 6 and 2). Optionally, relaxation chamber 819 is provided to dissipate any static which may build up due to fluid flow through the piping prior to the fuel entering the primary storage tank.

Piping 820 preferably connects vapor recovery tube 234 (FIGS. 2 and 6) to capped port 822, which is connectable to the supply truck via appropriate hosing (not shown) so that vapors contained in the primary storage tank can be recovered during a filling operation.

In order to remove fuel from the primary storage tank, a butterfly valve (not shown) on fuel pump 806 is turned to allow fuel to be pumped from piping 824, rather than from piping 804.

Piping 824 connects floating suction tube 242 (FIG. 2) to fuel pump 806, which pumps fuel to piping 826 and swivel 828, onto which a 2.5 inch aviation hose is preferably attachable for delivering the fuel to a bottom-loading truck in an airport environment. Flowmeter 830 is optionally provided to measure the amount of fuel received. Hose reel 832 is optionally provided with 1.5 inch hose 834 to fill an aircraft directly.

As discussed above, the interstitial space in the containment section is preferably purged of air and is replaced with an inert gas, such as nitrogen. By removing the oxygen (inherent in air) and creating an inert environment in the interstitial space, the present invention retards the explosion of any flammable fluids which may leak into or otherwise be contained within the interstitial space.

The temperature of the interstitial space will fluctuate, e.g., due to the solar energy impinging on the surface of the containment vessel, the temperature of the atmosphere surrounding the containment vessel, filling fuel into the primary storage tank, and/or withdrawing fuel therefrom.

The changes in temperature of the interstitial space proportionally affect the pressure of the inert gas located therein. For example, when the temperature decreases, the gas pressure decreases; when the temperature increases, the gas pressure increases.

As discussed above, containment dike emergency vent 126 (FIG. 1) is a pressure/vacuum vent set at about +2.0 lbs./−2 oz. Thus, atmosphere can enter into the interstitial space should the differential pressure between the interstitial space and the atmosphere drop below the low setting, and inert gas within the interstitial space can escape therethrough to atmosphere when the differential pressure therebetween exceeds the high setting.

The inert gas within the interstitial space is preferably pressurized to a pressure just below the upper differential pressure setting on emergency vent 126 (FIG. 1), e.g., about 1.5 psi. In order to minimize inert gas loss through the containment dike emergency vent, system 836 (FIG. 8) is preferably provided to maintain the pressure of the inert gas within the interstitial space.

Figure 9:
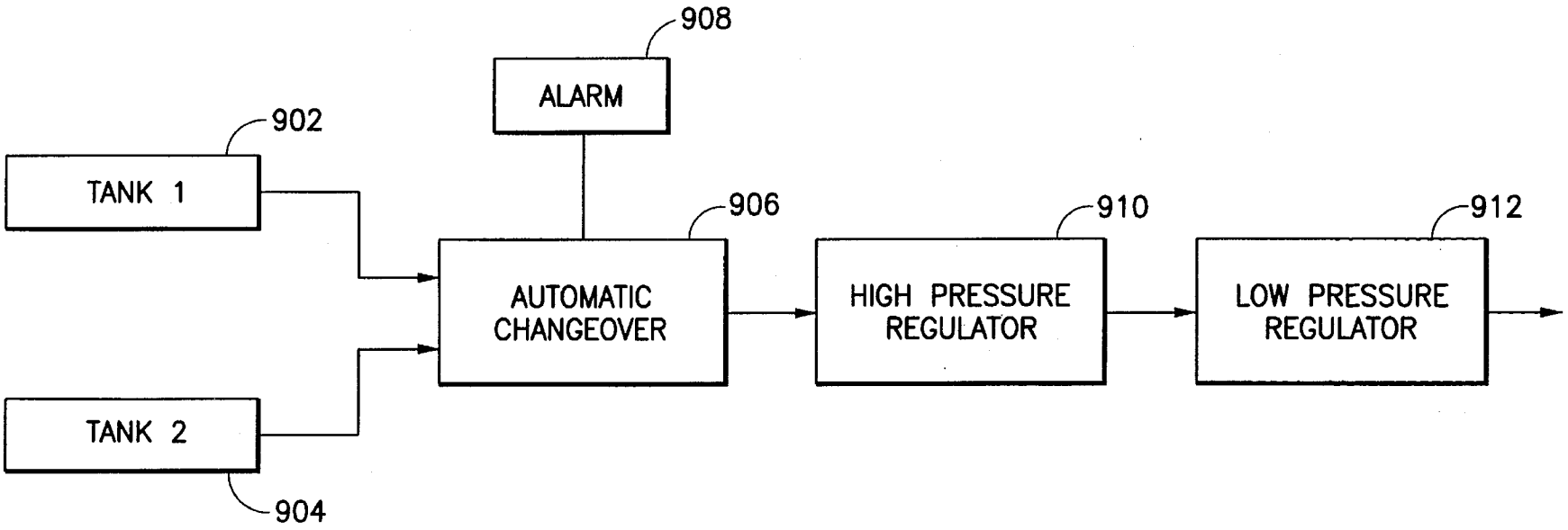
FIG. 9 is a schematic view of the system of maintaining the inert gas pressure within the interstitial space of the containment dike shown in FIG. 8.

With reference to FIG. 9, a schematic view of inert gas system 836 is shown. Inert gas is preferably stored in primary tank 902 and secondary tank 904 at an initial pressure of about 2000 pounds per square inch (psi). Tanks 902 and 904 are preferably high-pressure tanks each having a storage capacity of about 400 cubic feet.

Automatic changeover 906 initially receives the inert gas from primary tank 902. When the pressure of the gas contained in tank 902 drops below about 50 psi, automatic changeover 906 preferably switches over to receive the inert gas from secondary tank 904.

Figure 10:
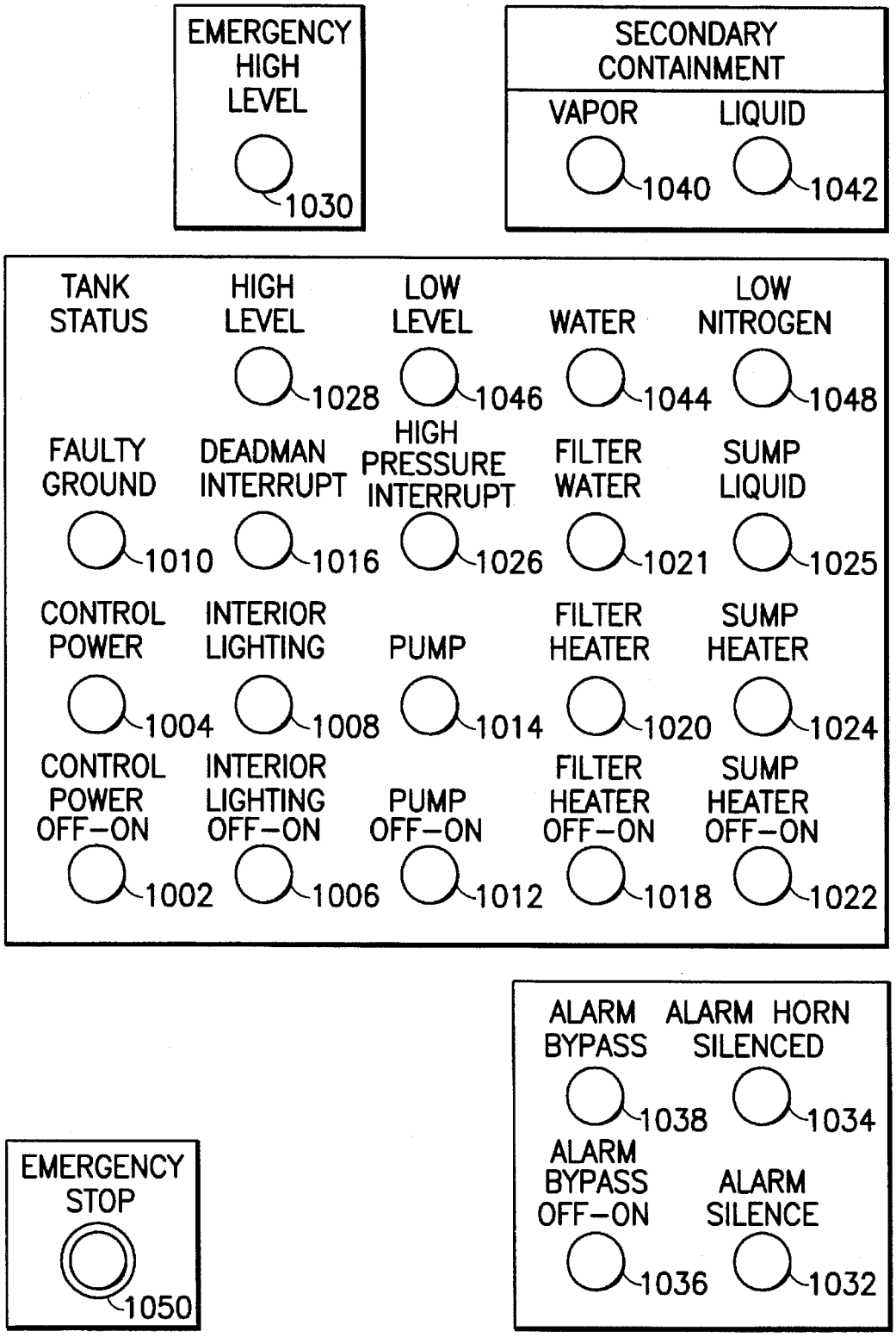
FIG. 10 is a depiction of an embodiment of the control panel shown on FIG. 1.

Alarm 908 is optionally provided to sense the pressure of the gas in the storage tank currently being ported to automatic changeover 906. When the pressure thereof drops below about 200 psi, alarm 908 preferably energizes a horn (not shown) and illuminates light 1048 on the control panel (FIG. 10, discussed in more detail below).

The alarm alerts a site manager to the fact that a tank changeover is imminent, and can arrange to have the tank refilled. Once alarm 908 is triggered, it preferably remains triggered until manual reset, thereby precluding a reset in the event of a tank changeover. Alternatively, the inert gas system can be configured with only one inert gas storage tank, thereby obviating the need for automatic changeover 906.

High pressure regulator 910 receives the inert gas from automatic changeover 906 and outputs the inert gas at a pressure of about 40 psi to low pressure regulator 912. Low pressure regulator 912 preferably outputs inert gas into the interstitial space at a positive pressure of about 1.5 water-column-inch (wci) at a maximum rate of about 250 cubic feet per hour. Low pressure regulator 912 is preferably available from Liquid Management Products, Bethel, Conn., as part number LV4403B2L04.

Due to fluctuations in the temperature of the interstitial space, the vapor pressure therein fluctuates. When the temperature therein increases, the vapor pressure therein also increases. Preferably, whenever the vapor pressure of the interstitial space is above the positive pressure setting of low pressure regulator 912, no inert gas flows into the interstitial space therefrom. When the differential pressure between the vapor pressure of the interstitial space and atmospheric pressure exceeds the pressure setting on emergency vent 126 (FIG. 1), inert gas in the interstitial space is preferably vented to atmosphere therethrough.

When the temperature of the interstitial space decreases, the vapor pressure therein also decreases. Preferably, when the vapor pressure of the interstitial space falls below the positive pressure setting of low pressure regulator 912, inert gas will flow into the interstitial space via low pressure regulator 912 until the pressure of the interstitial space is at least equal thereto. Should the vapor pressure of the interstitial space fall faster than the rate at which the low pressure regulator can compensate, and should the differential pressure between the interstitial space and atmospheric pressure drop to the vacuum setting on emergency vent 126 (FIG. 1), atmosphere will preferably vent therethrough into the interstitial space to avoid a vacuum condition.

Turning now to FIG. 10, a depiction of an embodiment of the control panel shown on FIG. 1 will now be discussed with reference to the operation of the containment vessel of the present invention.

Power is turned on via switch or pushbutton 1002, illuminating light 1004. Interior lighting (not shown) within the interior of the pumping compartment may be turned on via selector switch 1006, illuminating light 1008.

Before any fuel is offloaded from a supply truck carrying fuel to be delivered, the operator preferably manually checks the fluid level in the primary storage tank via stick access 222 to confirm the appropriateness of adding fuel to the storage tank.

After determining that a filling operation is appropriate, the driver connects a hose from the truck's tank to inlet port 802 (FIG. 8). A vapor recovery hose is also preferably connected from port 822 (FIG. 8) to the truck's vapor recovery inlet.

A grounding wire (not shown) from the containment vessel is connected to a grounding post on the truck (not shown). Should the containment vessel's grounding wire be damaged or otherwise ineffective, light 1010 will illuminate indicating same. Until proper grounding is achieved, the system preferably will not operate.

Selector switch 1012 enables fuel pump 806, illuminating light 1014. As known in the art, a deadman's handle (located on the hose connecting the supply truck to port 802) is intrinsically connected to the control panel by conventional means. Grasping the deadman's handle completes a circuit which allows the fuel pump to operate. In the event the grip on the deadman's handle is loosened during a filling operation, light 1016 illuminates to indicate an electrical interruption of that circuit and the fuel pump stops pumping.

During a filling operation, filter/separator 814 (FIG. 8) separates water from the fuel, diverting the water to sump 816. A thermostatically-controlled heater located in the sump area is enabled via selector switch 1018. When the heater turns on, light 1020 illuminates to indicate same.

The separated water collects in sump 816 until drawn off. Should the separated water reach a predetermined height in the sump, a liquid level detector (not shown) preferably causes the fuel pump to shut off until the water is drained therefrom. Light 1021 illuminates to indicate the high water level in the sump. Until the water level is below the high water level, the pump preferably does not operate.

The base of the pumping compartment, also referred to as a sump, should preferably be free from liquids. Thus, a liquid level detector (not shown) is preferably located at the base of the pumping compartment. Should the level of liquids therein reach a predetermined height, the liquid level detector preferably causes the fuel pump to shut down until the liquid is removed via a manually operated pump (not shown), commonly referred to as a thief pump.

Preferably, a thermostatically-controlled heater (not shown), enabled via selector switch 1022, is located in the sump of the pumping compartment to prevent liquids therein from freezing. When the heater turns on, light 1024 illuminates to indicate same. Should the level of liquids therein reach the predetermined height causing the fuel pump to turn off, light 1025 illuminates to indicate same.

When the level of the fuel in the primary storage tank approaches a predetermined height, indicative of the tank being substantially full, shut-off valve 233 begins to close its inlet to drop supply tube 232 (FIG. 2). As the inlet to the drop supply tube begins to close, the noise from the pumping motor changes due to the increasing back-pressure on the fuel pump. Thus, the driver can audibly determine that the tank is almost full. Additionally, a high pressure sensor (not shown) inline with piping 818 detects the back-pressure caused when the shut-off valve begins to close, causing the fuel pump to shut off and illuminating light 1026.

The remaining fuel located in the hose connected from the supply truck to the storage tank is preferably drained into the tank as follows. The driver releases the deadman's handle, thereby removing the high pressure in the piping and allowing the fuel pump to be reengaged. The dry brake (i.e., the valve on the supply truck to which the hose is connected) is then opened, closing the fuel port from the truck and allowing air to enter into the hose. The deadman's handle is closed, causing the fuel pump to operate, drawing the fuel remaining in the hose into the storage tank.

If the high pressure sensor inline with piping 818 fails and fuel continues to be pumped into the storage tank, shut-off valve 233 will fully close the inlet to the drop supply tube due to the rising fluid level in the storage tank. A pressure relief valve preferably located in the fuel pump detects the back pressure caused by the closed shut-off valve, opening a recirculation chamber which allows the fuel to recirculate therein.

The pumping motor preferably has timing circuitry inherent therewith to shut itself and the fuel pump off if the motor has continuously operated for a predetermined amount of time, calibrated to be just over the amount of time it would take to completely fill the storage tank from an empty level.

In the event the driver is unaware of the high-level status of the tank and continues to have the deadman's handle depressed, the pressure relief valve will open the recirculation chamber, and fuel will continue to recirculate in the fuel pump until the timing circuitry shuts the pump down.

If the high pressure sensor inline with piping 818 fails, and the shut-off valve fails, and the driver fails to notice that the amount of fuel being pumped exceeds the initial capacity thereof based on the manual stick reading, fuel will continue to be pumped into the storage tank. Preferably, volumetric controller 226 (FIG. 2) is programmed to detect a high level, defined as the level of fluid in the storage tank slightly above where it would be given a fully operative shut-off valve.

Should the volumetric controller detect a high level condition, it preferably shuts off the fuel pump, illuminates light 1028, energizes a horn (not shown), and energizes a flashing light (not shown), thereby alerting a site manager that the tank is in a high-level condition.

To silence the horn, pushbutton 1032 is depressed, illuminating light 1034. Power is restorable to the pumping motor via keyed selector switch 1036, illuminating light 1038. By restoring power to the pumping motor, the operator is able to draw fuel out of the storage tank by moving a butterfly valve on the fuel pump, thereby drawing fuel out of the tank via piping 824 to swivel 828 and hose thereconnected (FIG. 8).

After power to the pumping motor is restored via selector switch 1036, if the operator pumps more fuel into the tank rather than removing some fuel, emergency high-level detector 224 (FIG. 2) will detect the fluid level above the high-level condition set by the volumetric controller, causing an emergency high-level condition.

In an emergency high-level condition, the fuel pump shuts off, light 1030 illuminates, and the horn (not shown) and flashing light (not shown) are reenergized. In an emergency high-level condition, the pumping motor preferably cannot be reengaged via bypass 1036. Rather, the only way to lower the fluid level below the emergency high-level mark is to pump out the fuel through water purge line 262 (FIG. 2) via the manual thief pump (not shown) located within the pumping compartment.

In the event the high pressure sensor inline with piping 818 fails, the shut-off valve fails, the driver fails to notice that the amount of fuel being pumped exceeds the initial capacity thereof based on the manual stick reading, the high-level indication by the volumetric controller fails, and the emergency high-level detector fails, fuel will recirculate back to the supply truck via the vapor recovery line if it is hooked-up thereto. Otherwise, fuel will overflow into the interstitial space via primary storage tank emergency vent 240 (FIG. 2).

As discussed above, probing device 264 (FIG. 2) is preferably provided to detect liquid and/or vapors at the base of or otherwise within the interstitial space. If any liquid or fuel vapors are within the interstitial space, e.g., via the emergency vent, a leak in the primary storage tank, or otherwise, they are preferably detected by the probing device causing a secondary containment emergency condition.

In a secondary containment emergency condition, the fuel pump shuts off, the horn (not shown) is energized, light 1040 (in the case of vapor detection) and/or light 1042 (in the case of liquid detection) is illuminated. The horn is preferably silenced via pushbutton 1032, illuminating light 1034. Interstitial suction line 268 (FIG. 2) is preferably provided to purge the liquid and/or fuel vapor from the interstitial space.

To remove fuel from the primary storage tank (either in a high level condition or to provide fuel as needed), the butterfly valve (not shown) on the fuel pump is operated to allow the fuel pump to remove fuel via floating suction tube 242 (FIG. 2), which ultimately pumps fuel to swivel 828 (FIG. 8), onto which a 2.5 inch aviation hose is preferably attachable for delivering the fuel to a bottom-loading truck in an airport environment.

When water is detected at the bottom of the storage tank by the volumetric controller, light 1044 preferably illuminates to indicate same.

As discussed above, the volumetric controller is programmable to indicate a user-defined "low level." When the volumetric controller detects the low level, light 1046 illuminates.

As discussed above with reference to FIG. 9, inert gas system 836 (FIG. 8) is preferably provided to maintain the pressure of the inert gas within the interstitial space. When the pressure of the inert gas within one of the storage tanks falls below a predetermined pressure, e.g., 200 psi, light 1048 illuminates.

Emergency stop button 1050 can be depressed at any time during the filling or removal operation, thereby turning off all power until the button is reset.

The control panel optionally has a positive pressure of inert gas vented therethrough. There are many benefits to venting the control panel with a positive pressure. For example, the control panel can be rated as explosion proof. Additionally, its placement is made easier according to applicable NEC regulations. By venting with an inert gas, the inert environment created thereby increases the service life of the panel, due to the non-corrosive, non-conductive environment.

The structural dimensions of the containment vessel of the present invention are preferably as follows. The side walls are preferably about 5 feet, 7 inches high and are located about 10 feet apart. The roof preferably has a semi-circular cross-section having a 5 foot radius, and is preferably 5 feet high and 10 feet wide. The base, side walls, and semicircular roof preferably completely enclose the primary storage tank.

Structural advantages are gained by a semi-circular roof which completely encloses the primary storage tank. For example, the amount of interstitial space is increased, relative to prior art designs.

Specifically, for a primary storage tank capable of storing about 20,000 gallons of fuel, the tank is about 40 feet long (given a cylindrical tank with a 9' 3" diameter). Given a distance between the firewall and the rear wall, i.e., the length of the containment dike, of preferably 41 feet, 6 inches, the interstitial space is capable of about a 48% overfill capacity, relative to the volumetric capacity of the primary storage tank. Thus, should the primary storage tank overfill or leak, the containment dike preferably can contain all of the liquid in the primary storage tank, as well as an additional 48%.

For a primary storage tank capable of storing about 12,000 gallons of fuel, the tank is about 24 feet long (given a cylindrical tank with a 9' 3" diameter). Given a distance between the firewall and the rear wall of preferably 25 feet, 6 inches, the interstitial space is capable of about a 51% overfill capacity, relative to the volumetric capacity of the primary storage tank. Thus, the containment dike preferably can contain all of the liquid in the primary storage tank, as well as an additional 51%.

Another advantage of the semi-circular roof is the ability to easily pressurize the interstitial space. By pressurizing the interstitial space with an inert gas, an explosion-retardant environment is created.

Additionally, the semi-circular roof offers greater solar energy reflectivity, relative to a roof having flat panels. Thus, a higher percentage of sunlight is reflected, minimizing the amount of thermal energy absorbed by the interstitial space.

Other advantages are gained by a pumping compartment which is integral with the containment dike. For example, the containment vessel is self-contained. Additionally, the unibody construction totally encloses the storage tank, the pumping compartment, and all piping therebetween. Thus, leaks are contained, piping is protected and the unit is easily transportable. The distance between the firewall and the front wall, i.e., the length of the pumping compartment, is preferably about 4 feet.

Structural advantages are also gained by the beams located between the saddles, and between the saddles and the front wall and firewall. For example, the containment vessel of the present invention can withstand a direct collision of 60,000 pounds at 10 m.p.h. Additionally, the containment vessel can withstand an external flood of 6 feet given a wall and roof thickness of 3/16 inch steel, or an external flood of 11 feet (total containment vessel submersion) given a wall and roof thickness of ¼ inch steel.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What I claim as my invention is:

1. An above-ground, explosion-retardant containment vessel capable of storing a flammable liquid, said containment vessel comprising:

a substantially rigid primary storage tank capable of storing the flammable liquid, said primary storage tank having a predetermined volumetric capacity;

a substantially rigid containment dike completely enclosing said primary storage tank, said containment dike forming an interstitial space between the exterior of said primary storage tank and the interior of said containment dike, said containment dike being gas-tight and liquid-tight to contain any fluid leakage from said primary storage tank within the interstitial space;

a working vent from the interior of said primary storage tank to the exterior of said containment dike, said working vent including a device to restrict the flow of liquids therethrough, said working vent to allow vapor communication between the interior of said primary storage tank and the exterior of said containment dike; and a first emergency vent operatively attached to said primary storage tank, said first emergency vent to allow conditional fluid communication between the interior of said primary storage tank and the interstitial space in the event the amount of fluid within said primary storage tank exceeds the predetermined capacity thereof.

2. The containment vessel of claim 1, wherein the interstitial space comprises an inert atmosphere which is substantially free of oxygen, said containment vessel further comprising a system capable of maintaining the pressure of said inert atmosphere to at least a predetermined pressure despite temperature variations, said system comprising:

a supply of inert gas pressurized to a first pressure, the first pressure being substantially higher than the predetermined pressure;

a first pressure regulator operatively connected to said inert gas supply, said first pressure regulator capable of reducing the first pressure of said inert gas to an intermediate pressure between the first pressure and the predetermined pressure, and outputting said intermediate pressure; and a second pressure regulator operatively connected between the output of said first pressure regulator and the interstitial space, said second pressure regulator capable of maintaining the pressure of said inert atmosphere to at least the predetermined pressure by selectively supplying the interstitial space with said inert gas at the predetermined pressure.

3. The containment vessel of claim 1, wherein the interstitial space is capable of containing at least 35% of the volumetric capacity of said primary storage tank.

4. The containment vessel of claim 1, said containment vessel further comprising a second emergency vent operatively attached to said containment dike, said second emergency vent to allow conditional fluid communication between the interstitial space and the exterior of said containment dike in the event the amount of fluid within the interstitial space exceeds the capacity thereof.

5. The containment vessel of claim 1, said containment vessel further comprising a second emergency vent operatively attached to a top portion of said containment dike, said second emergency vent to allow conditional fluid communication between the interior of said containment dike and the exterior thereof in the event the amount of fluid within the interstitial space exceeds the capacity thereof.

6. An above-ground containment vessel for the storage of a flammable liquid, said containment vessel comprising:

a substantially rigid primary storage tank capable of storing the flammable liquid, said primary storage tank having a predetermined volumetric capacity; and a substantially rigid containment dike completely surrounding said primary storage tank, said containment dike forming an interstitial space between the exterior of said primary storage tank and the interior of said containment dike, said containment dike being substantially air-tight and liquid-tight to contain any leakage from said primary storage tank within the interstitial space;

a working vent from the interior of said primary storage tank to the exterior of said containment dike, said working vent including a device to restrict the flow of liquids therethrough, said working vent to allow vapor communication between the interior of said primary storage tank and the exterior of said containment dike;

an emergency vent operatively attached to a top portion of said primary storage tank, said emergency vent to allow conditional fluid communication between the interior of said primary storage tank and the interstitial space in the event the amount of fluid within said primary storage tank exceeds the predetermined capacity thereof; and a pumping compartment integrally connected to said containment dike, said pumping compartment capable of either pumping liquid into said primary storage tank or drawing liquid therefrom.

* * * * *